US006152458A

United States Patent [19]

Edauw et al.

[11] Patent Number: 6,152,458

[45] Date of Patent: Nov. 28, 2000

[54] ICE SKATE

[75] Inventors: Peter Edauw, Camalo' Di Povegliano, Italy; Stephane Logger, HX Delft, Netherlands

[73] Assignee: Stylus S.p.A., Castelfranco Veneto, Italy

[21] Appl. No.: 09/185,693

[22] Filed: Nov. 4, 1998

[30] Foreign Application Priority Data

Nov. 6, 1997 [IT] Italy ..... TV97A0155

[51] Int. Cl.[7] ..... A63C 1/24

[52] U.S. Cl. ..... 280/11.14; 280/11.27; 280/625

[58] Field of Search ..... 280/11.12, 11.14, 280/11.15, 11.16, 11.22, 11.27, 615

[56] References Cited

U.S. PATENT DOCUMENTS

| | | | |
|---|---|---|---|
| 32,360 | 5/1861 | Goodyear | 280/11.14 |
| 267,111 | 11/1882 | Riebling | 280/11.15 |
| 330,133 | 11/1885 | Lapp | 280/11.15 |
| 396,413 | 1/1889 | McQuown | 280/11.14 |
| 454,040 | 6/1891 | Freese | 280/11.14 |
| 1,228,544 | 6/1917 | Falstrem et al. | 280/11.15 |
| 1,603,588 | 10/1926 | Eberle | 280/11.15 |
| 1,702,316 | 2/1929 | Ridgers | 280/11.15 |
| 1,702,695 | 2/1929 | Hoult . | |
| 1,789,182 | 1/1931 | Klevstad | 280/11.14 |
| 2,950,118 | 8/1960 | Sharpe | 280/11.14 |
| 5,046,746 | 9/1991 | Gierveld | 280/11.22 |
| 5,452,907 | 9/1995 | Meibock et al. | 280/11.22 |
| 5,741,019 | 4/1998 | Lu | 280/11.22 |
| 5,890,724 | 4/1999 | Gignoux et al. | 280/11.22 X |
| 6,007,075 | 12/1999 | Shum | 280/11.12 |

FOREIGN PATENT DOCUMENTS

| | | | |
|---|---|---|---|
| 0 718 012 | 6/1996 | European Pat. Off. . | |
| 192312 | 8/1996 | European Pat. Off. | 280/11.15 |
| 78 733 | 1/1894 | Germany . | |
| 9613 | 5/1894 | Germany | 280/11.15 |
| 78733 | 12/1894 | Germany | 280/11.15 |
| 8602796 | 6/1988 | Netherlands | 280/11.14 |
| 4061 | 11/1877 | United Kingdom | 280/11.15 |
| 2 160 780 | 1/1986 | United Kingdom . | |
| 93 14840 | 8/1993 | WIPO . | |
| 96 37269 | 11/1996 | WIPO . | |

OTHER PUBLICATIONS

"Klapschaats Nu Produktierijp" Ingenieur, vol. 107, No. 18, Nov. 8, 1995, p. 47 XP000539646.

*Primary Examiner*—Lanna Mai
*Attorney, Agent, or Firm*—Rockey, Milnamow & Katz, Ltd.

[57] ABSTRACT

An ice skate, particularly for speed skating includes an upper half-frame provided with means for coupling to a shoe which oscillates on a same plane with respect to a lower half-frame which is associated with a blade which interacts with the ice. The upper half-frame of the skate can perform a forward translatory motion of the heel region and a backward translatory motion of the tip region. This allows the user to improve his skating.

10 Claims, 7 Drawing Sheets

Fig. 10 PRIOR ART
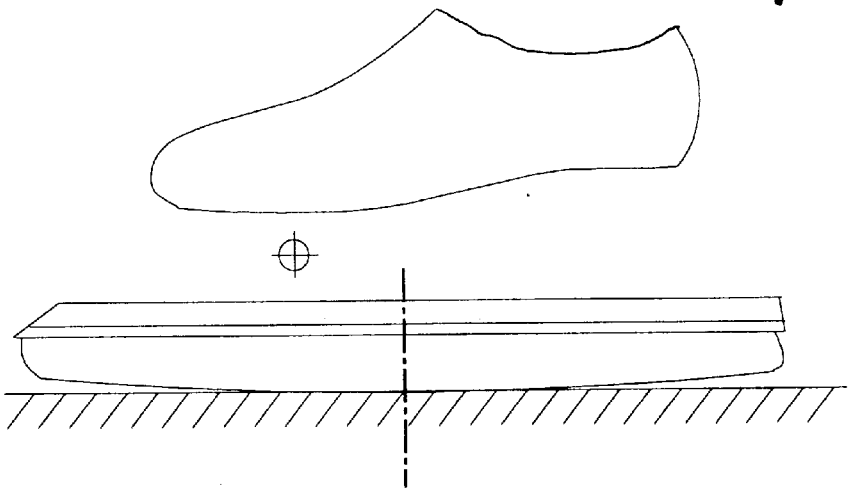
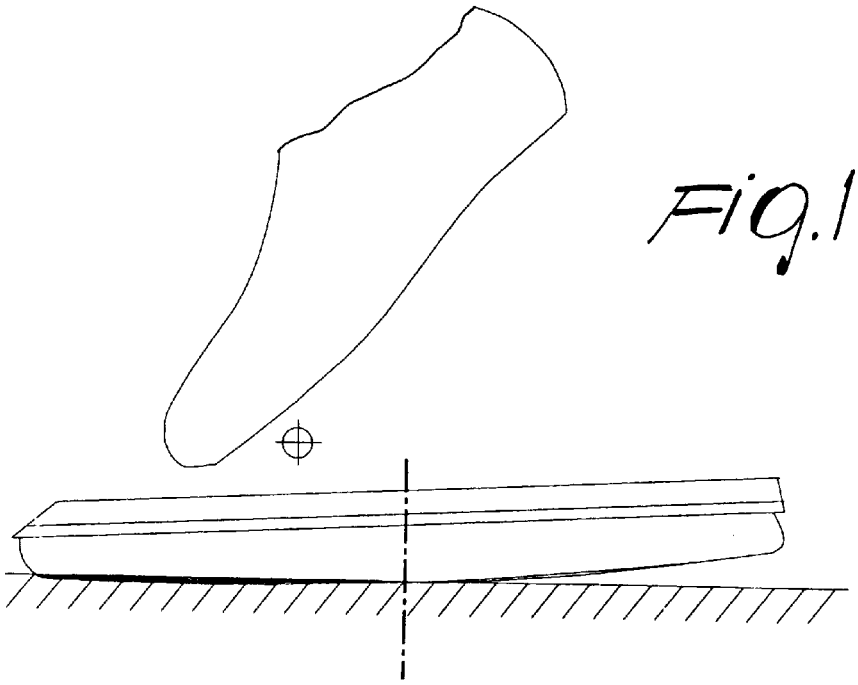
Fig. 11 PRIOR ART

ICE SKATE

BACKGROUND OF THE INVENTION

The present invention relates to an ice skate, particularly for speed skating.

Conventional ice skates are generally composed of a shoe associated with a support having a longitudinal steel blade which is used as a means for gliding on a frozen surface.

In conventional ice skates the shoe support is coupled to the blade in a fixed manner, so that every movement of the foot is matched by an equal movement of the support and therefore of the blade.

However, said conventional types of skate do not allow the user to skate in an optimum manner, since they do not allow optimum transmission of efforts from the foot to the blade because for example during thrusting the front part of the blade is loaded and may therefore catch at discontinuities in the ice.

WO 96/37269 discloses a frame for ice skates comprising an upper half-frame with means for coupling to a shoe and a lower half-frame which is coupled, by means of pivoting mechanisms, to said upper half-frame for an oscillation on a main plane. The half-frames can oscillate with respect to each other and perform a translatory motion along said main plane, entailing a forward oscillation of the foot both at the tip region and at the heel region.

A schematic illustration of the movement of the foot which can be achieved with this solution is given in the accompanying FIGS. 3, 10 and 11.

As mentioned, in this solution the translatory and rotary motion of the half-frames produces a forward movement of the entire foot and therefore of both the tip and the heel; bearing in mind that the blade of the ice skate is usually radiused, in the above solution the foot performs a forward movement, loading the front part of the blade, whose primary function is not thrusting but control.

Moreover, loading the forward region of the blade makes the blade penetrate the ice and may cause jamming at other discontinuities in the ice, accordingly making the skating action less efficient.

During thrusting, the point of the blade in contact with the ice that yields the highest efficiency can in fact be determined by means of a biomechanical study of the thrusting action: this study leads to consider that the part of the blade that allows highest efficiency during thrusting is the rearmost part, as shown for example in WO 9601671, which shows that during gliding over the ice the position of the skater entails a backward-shifted position of the pelvis so that the center of gravity is arranged at the point of contact between the blade and the ice.

The result is that the tip of the blade is not in contact with the ice while the rearward part of the blade is. This allows better gliding, since friction between the blade and the ice occurs in a point corresponding to the center of gravity of the skater and therefore in a point of higher inertia.

During thrusting, the blade is arranged edgeways on the ice, assuming, by means of the backward-shifted pelvis position, that the rearward region of the blade is always the one that is interfaced with the ice: in skating biomechanics terms, the thrusting line runs through the extension of the leg along a path which is determined by the alignment of the trunk, pelvis, knee, and ankle, and the continuation of said line through the ice allows to determine the point of contact between the blade and the ice which ensures the most efficient return of energy. This means higher acceleration in relation to the energy transmitted by the skater.

The cited skates force the skater to use the front part of the blade during the last steps of the thrusting action and this entails a slight speed reduction or braking effect due to the fact that the blade tends to catch in the ice and cut a groove.

This factor is even more important when skating on natural ice, which often has many cracks and imperfections and where the above-mentioned catching therefore occurs.

Therefore, the skater runs the risk of guiding the blade into one of these grooves rather than making the blade pass beyond this obstacle, but this requires continuous trajectory corrections, wasting energy which would be useful in skating.

SUMMARY OF THE INVENTION

An aim of the present invention is to solve the above-mentioned technical problems, eliminating the drawbacks of the cited prior art by providing an ice skate, particularly for speed skating, which allows more efficient thrusting during skating.

An important object of the present invention is to provide an ice skate which allows optimum control of the blade even in the presence of grooves in the ice.

A further important object is to provide an ice skate in which the blade does not catch on the ice during thrusting.

A further important object is to provide an ice skate which allows the user to perform a biomechanically correct. movement of the foot during thrusting.

A further important object is to provide an ice skate which optimizes interaction between the blade and the ice throughout skating, allowing the foot to maintain an optimum position in every step while skating.

Still a further object is to provide a structurally simple ice skate which is reliable and safe in use and has low manufacturing costs.

The above aim and objects, and others which will become apparent hereinafter, are achieved by an ice skate, particularly for speed skating comprising an upper half-frame having an articulation means for coupling to a foot support member which oscillates on a same plane with respect to a lower half-frame which is associated with a blade, characterized in that it comprises an articulation means which allows said upper half-frame to perform a forward translatory motion of the heel region and a backward translatory motion of the tip region.

BRIEF DESCRIPTION OF THE DRAWINGS

Further characteristics and advantages of the invention will become apparent from the following detailed description of a particular but not exclusive embodiment, illustrated by way of a nonlimitative example in the accompanying drawings, wherein:

FIG. 10 is a view, similar to FIG. 9, of the initial condition of the position of the foot according to the prior art;

FIG. 11 is a view, similar to FIG. 10, of the final condition assumed by the foot according to the prior art.

DESCRIPTION OF THE PREFERRED EMBODIMENTS

Figure 1:
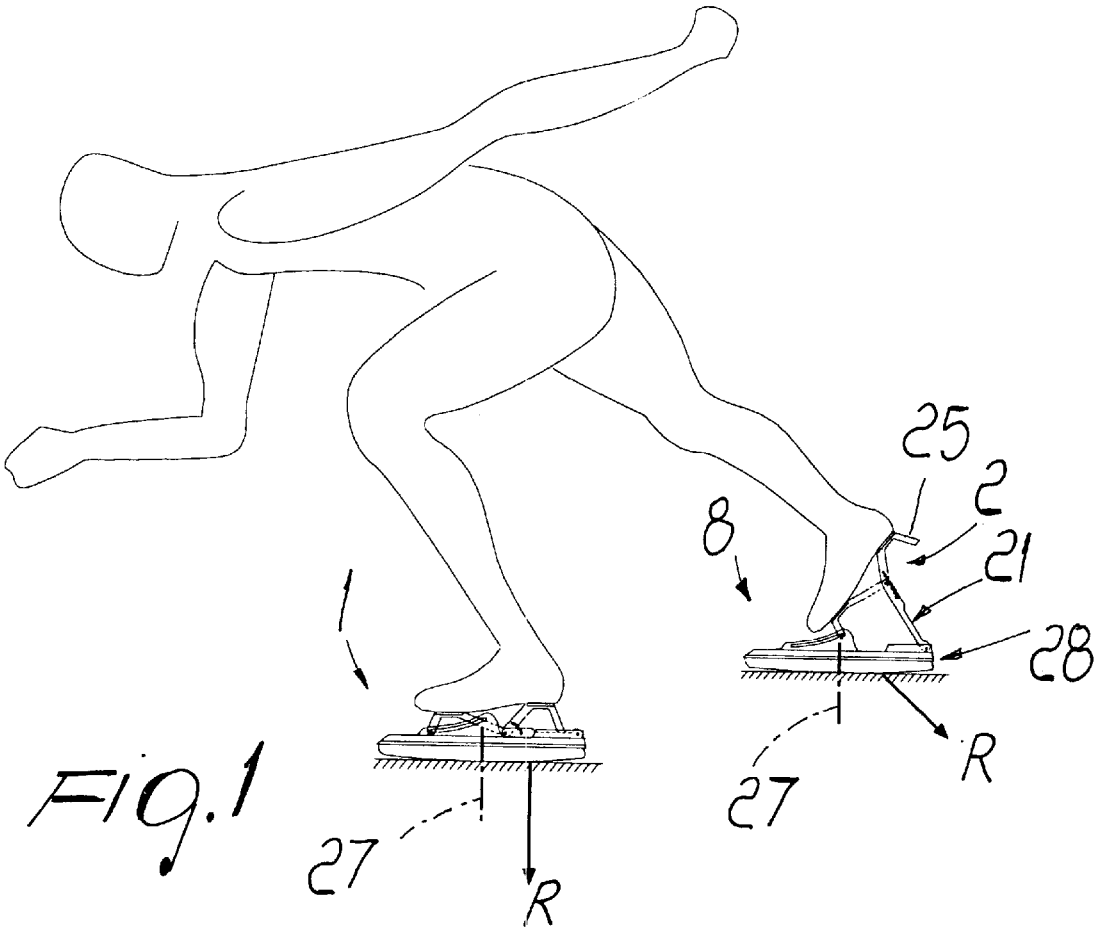
FIG. 1 is a schematic view of a skater using the skates according to the invention.

With reference to the above figures, 1 designates a frame for ice skates, particularly for speed skating comprising an upper half-frame 2 which is constituted by a substantially V-shaped bar. The free ends of the bar are associated with a foot support member, for example a shoe 3, by means of a pair of bases 4 having first slots 5 for connection to the sole of the shoe by means of, for example, screws or rivets.

Advantageously, bases 4 are arranged respectively at the region 6 of the tip of the foot and at the heel region 7.

The frame comprises an articulation means which allow said upper half-frame 2 to perform a forward translatory motion of the heel region 7 and a backward translatory motion of the tip region 6 with respect to a lower half-frame 8 which is rigidly coupled to an ice skating blade 9 of the type having an arc-like configuration which forms a limited region 10 for interaction with the ice 11.

Said articulation means comprises a first tab 12 which protrudes at the end of the base 4 arranged at the tip region 6. First tab 12 protrudes downwards and forwards with respect to the base.

The tip of said first tab 12 is freely pivoted, by means of a first pivot 13, at a pair of second slots 14*a* and 14*b* provided at a suitable pair of first shoulders 15*a*, 15*b* protruding upward on planes which are parallel to a flat surface 16 of lower half-frame 8.

The second slots 14*a* and 14*b* have an arc-like shape, with a first end 17 which is adjacent to said flat surface 16 and a second end 18 which is spaced further from said flat surface.

The second slots 14*a* and 14*b* have an arc-like shape whose concavity is directed toward the ice.

The distance between the first shoulders 15*a* and 15*b* is such as to allow to slidingly position the first tab 12 between said shoulders, optionally interposing a material which is adapted to improve sliding.

The upper half-frame 2 is articulated at its vertex, by means of a second pivot 19, to a pair of wings 20 of an arm 21 which is freely pivoted, at its other end, by means of a third pivot 22, to a pair of second shoulders 23*a* and 23*b* protruding above said flat surface 16 of the lower half-frame 8 at the heel region 7.

Advantageously, the third pivot 22 is associated proximate to the rear end of said pair of second shoulders 23*a*, 23*b*.

The articulation between said lower half-frame 8 and said upper half-frame 2 is limited by the presence of a flexible element which can be interposed between them. Said element is constituted by a cylindrical helical elongation spring 24 which is interposed between the arm 21 and the adjacent wing of the upper half-frame 2 which is directed toward the heel region 7.

Figure 5:
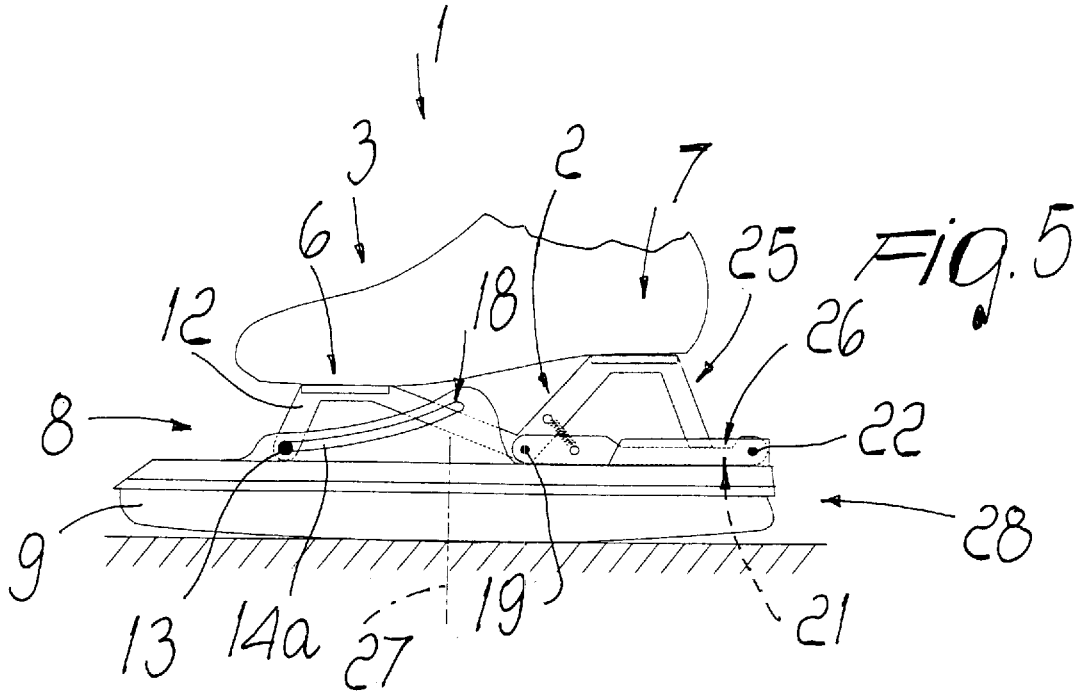
FIGS. 5, 6 and 7 are side views of the skate showing the articulation of the frame in different positions.

A second tab 25 protrudes at the tip of the base 4 that lies below the heel region 7 and can be arranged, in the inactive condition, at a suitable recess 26 formed in the arm 21, as shown in FIG. 5.

Figure 4:
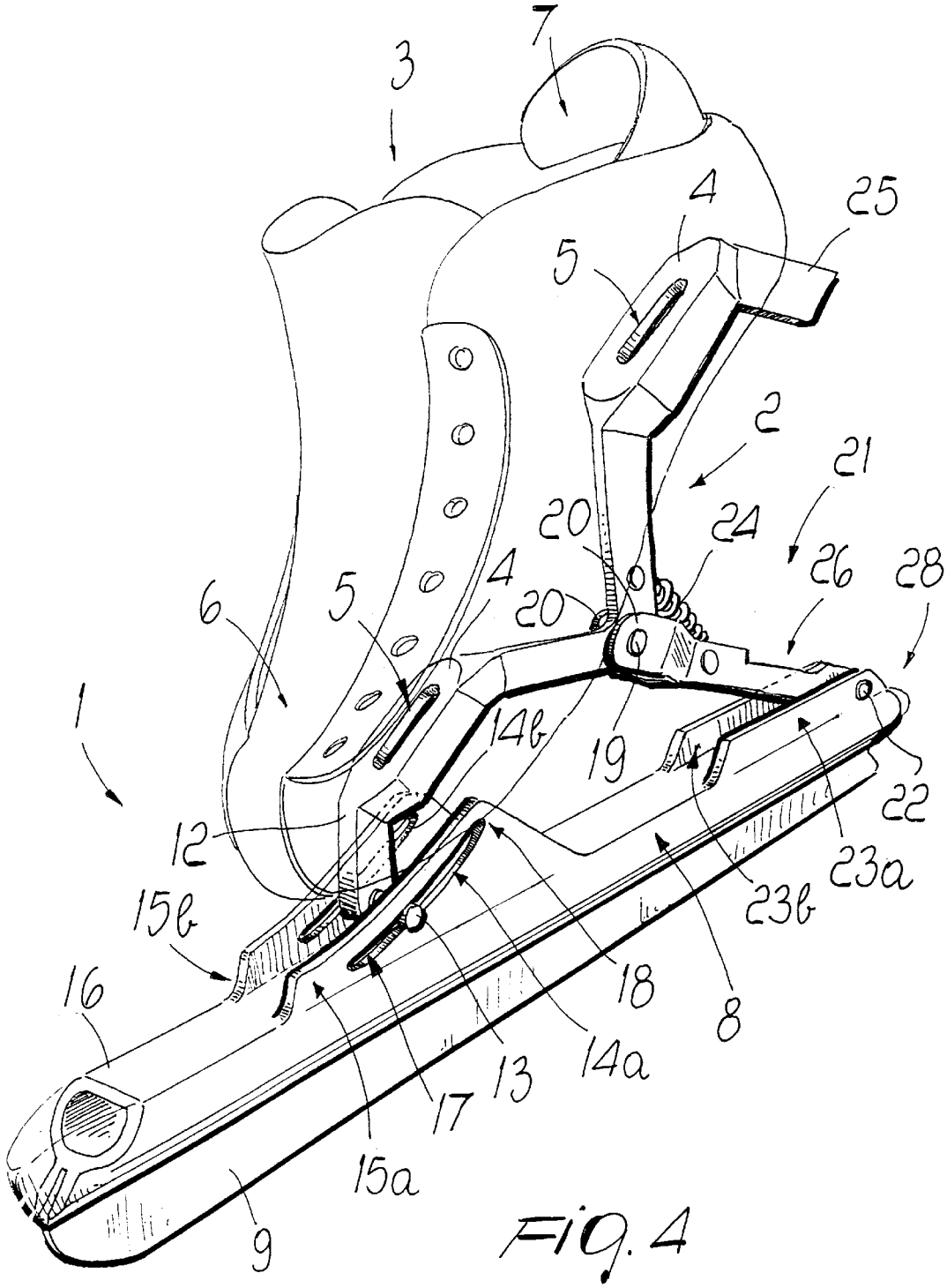
FIG. 4 is a partially sectional side perspective view of the skate according to the invention.

The longitudinal extension of the arm 21 and the dimensions of the upper half-frame 2 and of the pair of first shoulders 15*a* and 15*b* is such as to allow, in the inactive condition shown in FIG. 4, the arm 21 to rest on the flat surface 16 of the lower half-frame 8 so that the end that is articulated to the upper half-frame 2 lies proximate to the tip of the adjacent first shoulders 15*a* and 15*b*. In this condition the first pivot 13 abuts against the first end 17 of the second slots 14*a* and 14*b*.

In this condition, the foot is therefore arranged approximately parallel to the surface of the ice 11.

Figure 6:
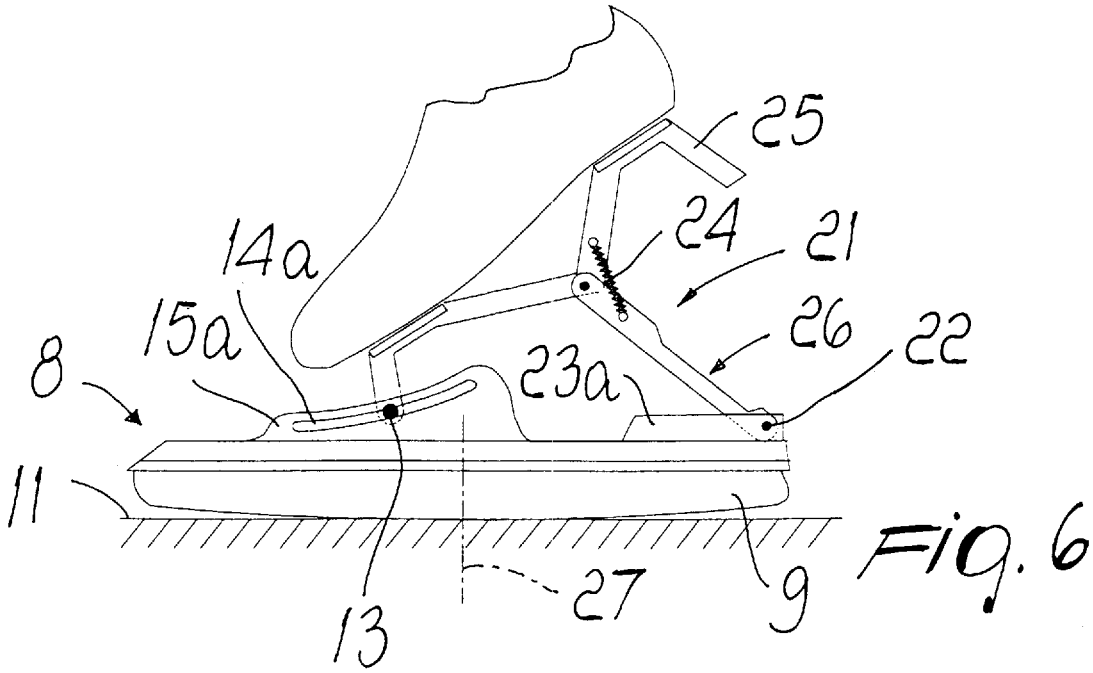
Figure 7:
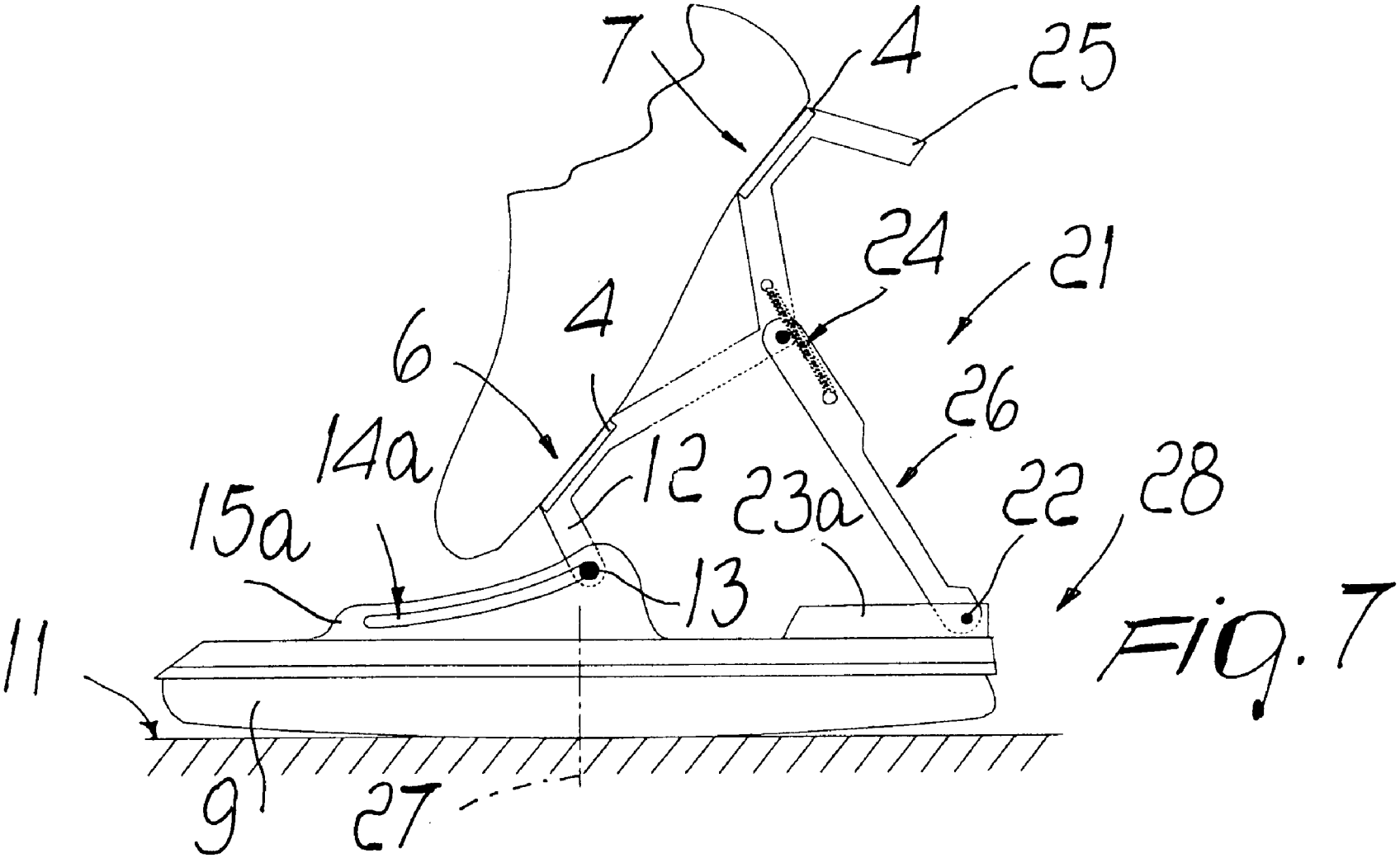
Figure 8:
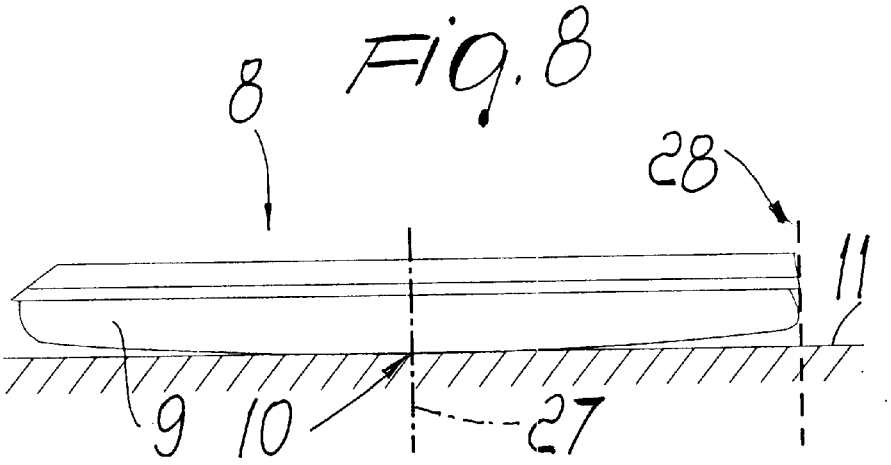
FIG. 8 is a side view of a conventional ice skating blade.

The use of the invention is as follows: FIGS. 5, 6 and 7 show the three significant steps that illustrate the articulation and translatory motion of the shoe which occur during the extension produced by the thrusting and extension action during skating.

In FIG. 5, the frame is in the inactive position, whereas in FIG. 6 the frame is approximately extended halfway.

During this step, the first pivot 13 slides within the second slots 14*a* and 14*b* so as to move from the first end 17 to the second end 18, while the arm 21 performs a clockwise rotation which allows the shoe to rise.

FIG. 7 illustrates the condition in which the frame assumes its maximum extension and shows that the heel region 7 is allowed to perform a forward translatory motion and the tip region 6 is allowed to perform a backward translatory motion.

Figure 2:
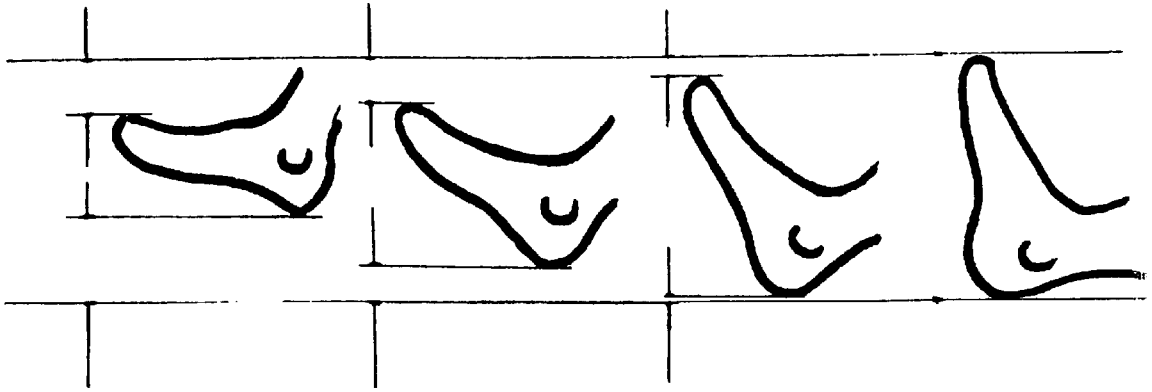
FIG. 2 is a schematic view of the movement performed by the foot during thrusting as allowed by the skate according to the present invention.
Figure 3:
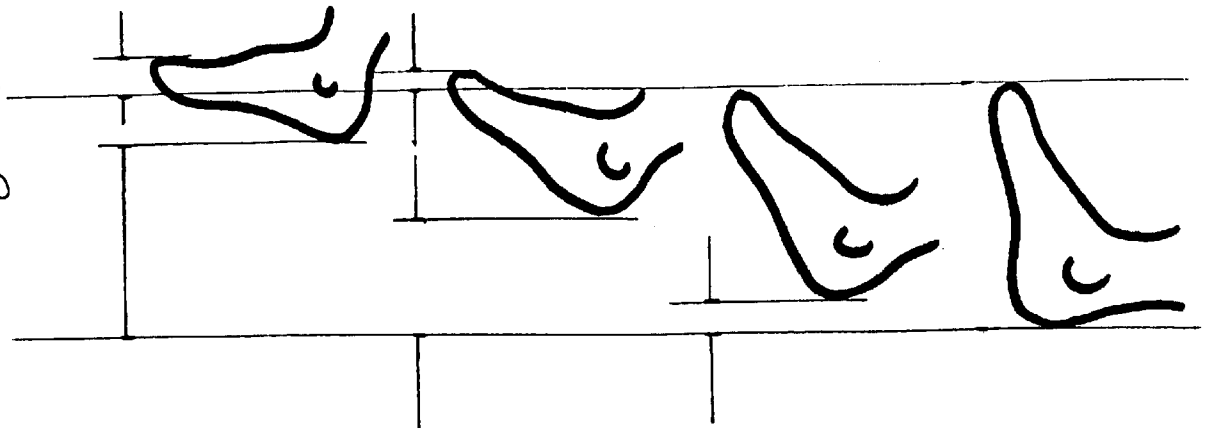
Fig. 3 PRIOR ART
FIG. 3 is a view, similar to FIG. 2, of the movement that the foot can perform according to the prior art described in the above cited patent.

This condition is shown in FIG. 2 and shows that it allows to apply the load, during maximum thrusting, to the blade in a rearward region with respect to a median axis 27 thereof.

In view of the radiused shape of the blade 9 and of the forces that act thereon due to thrusting by means of the configuration of the upper half-frame, of the lower half-frame and of the means associated therewith, the resulting force R on the blade is assuredly located in the interspace between the median axis 27 and the rear end 28 of said blade, therefore allowing the front part of the blade to rise, passing over the obstacles that are often present in natural ice, such as for example ice produced by natural elements such as wind and temperature.

In the maximum extension condition, shown in FIG. 7, it can be seen that the first pivot 13 is arranged towards the rear end 28 of the blade 9 on the nearer side of the median axis 27, so that any further thrusting always ensures transmission of force to the blade in the interspace between the median axis 27 and the rear end of said blade.

Figure 9:
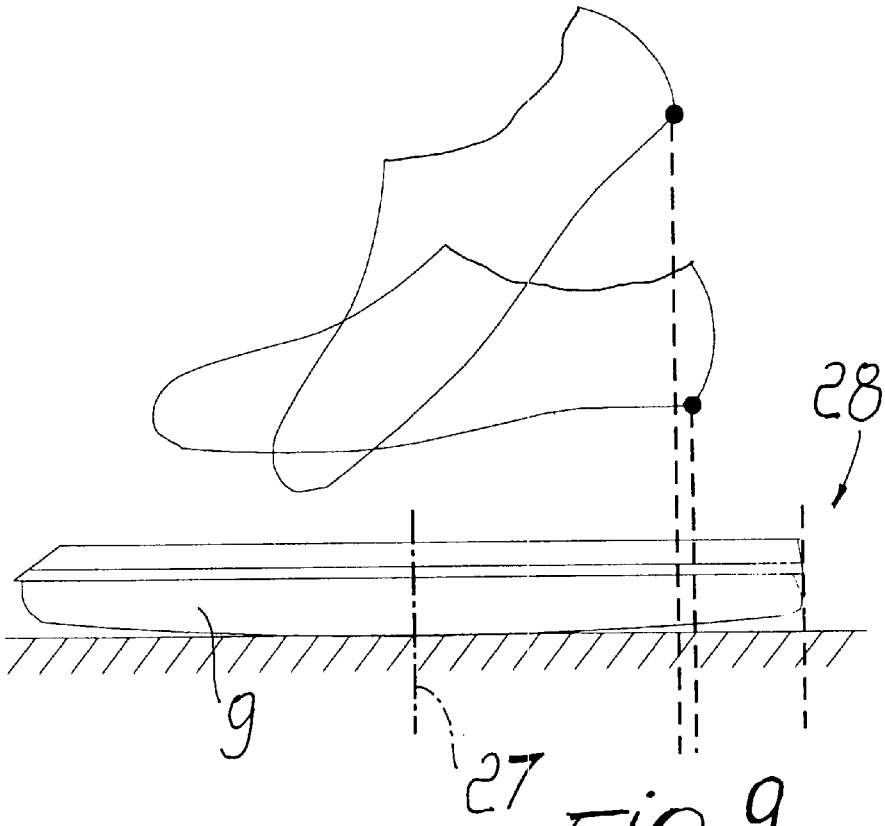
FIG. 9 is a view, similar to FIG. 8, of the position assumed by the foot during the initial and final steps of the skating stride.

As shown in FIG. 9, in the embodiment according to the present invention, the position of the heel varies very little between the inactive condition and the maximum extension condition, accordingly maintaining high efficiency in thrusting and very easy control during gliding, and this occurs both during thrusting and during the stride.

It has thus been observed that the invention has achieved the intended aim and objects, by providing a skate which allows to improve the efficiency of thrusting during skating and to achieve optimum control of the blade even in the presence of grooves in the ice.

Moreover, there is no catching of the front part of the blade on the ice, allowing the user to perform a biomechanically correct movement for the foot during thrusting and in general during any step of skating.

Finally, the skate according to the invention is structurally simple, is composed of a limited number of components and has low manufacturing costs, since the components can be manufactured by automated machining.

In this last case, since the frame is not based on the use of a single articulation, which requires mechanical characteristics which are present only in machinable metals or metal alloys, in fact allows the use components obtained by means of more highly industrial processes, such as injection of high-performance polymers, die-casting of metal alloys or machining of extruded parts.

The skate according to the invention is susceptible of numerous modifications and variations within the scope of the appended claims.

The materials and the dimensions that constitute the individual components of the structure may of course also be the most pertinent according to specific requirements.

The disclosures in Italian Patent Application No. TV97A000155 from which this application claims priority are incorporated herein by reference.

What is claimed is:

1. An ice skate, particularly for speed skating comprising an upper half-frame having an articulation means for coupling to a foot support member which oscillates on a same plane with respect to a lower half-frame which is associated with a blade, comprising an articulation means which allows said upper half-frame to perform a forward translatory motion of a heel region and a backward translatory motion of a tip region, said upper half-frame comprising a substantially V-shaped bar having free ends, coupling means being provided at said free ends for coupling to a shoe, said coupling means comprising a pair of bases, said bases being arranged at the tip region and at the heel region, first slots being provided at the bases for connection to said foot support, said articulation means further comprising a first tab which protrudes at the end of said base that is arranged at a tip region, said first tab protruding in a downward direction and forwards with respect to said base, the tip of said first tab being freely pivoted, by means of a first pivot, at second slots formed at first shoulders which protrude upward and along planes which are parallel to a flat surface of said lower half-frame, said second slots having an arc-like shape, with a first end which is adjacent to said flat surface and with a second end which is further spaced from said flat surface, said second slots having a concavity directed toward the ice surface.

2. The skate according to claim 1, wherein the distance between said first shoulders is such as to allow the positioning and sliding of said first tab between said first shoulders, with an interposition of a material suitable to improve sliding.

3. The skate according to claim 2, wherein said upper half-frame is articulated at a vertex thereof, by means of a second pivot, to a pair of wings of an arm which is freely pivoted at a distal end, by means of a third pivot, to a pair of second shoulders which protrude in an upward region with respect to said flat surface of said lower half-frame at the heel region.

4. The skate according to claim 3, wherein said third pivot is associated proximate to a rear end of said pair of second shoulders.

5. The skate according to claim 4, wherein the articulation between said lower and upper half-frames is limited by a flexible element which is interposed between said lower and upper half-frames, said flexible element being constituted by a cylindrical helical elongation spring which is interposed between said arm and an adjacent wing of said upper half-frame that is directed toward the heel region.

6. The skate according to claim 5, wherein a second tab protrudes at a tip of said base that lies below the heel region and can be positioned, in an inactive condition, at a recess formed in said arm, a longitudinal extension of said arm and dimensions of said upper half-frame and of said pair of first shoulders being such as to allow, in the inactive condition, said arm to rest on said flat surface of said lower half-frame so that an end that is articulated to said upper half-frame is proximate to the tip of said adjacent first shoulders, said first pivot being arranged, in this condition, in abutment against said first end of said second slots.

7. The skate according to claim 6, wherein during extension said first pivot slides within said second slots and moves from said first end to said second end while said arm performs a clockwise rotation which allows the shoe to rise.

8. The skate according to claim 1, wherein in a maximum extension condition a force applied to said blade, due to thrusting, is located in an interspace between a median axis of said blade and a rear end of said blade.

9. The skate according to claim 1, wherein in a maximum extension condition said first pivot is arranged at a point which lies on an axis which is rearward with respect to a median axis of said blade.

10. An ice skate comprising an upper half-frame having an articulation means for coupling to a foot support member which oscillates on a same plane with respect to a lower half-frame which is associated with a blade, comprising an articulation means which allows said upper half-frame to perform a forward translatory motion of a heel region and a backward translatory motion of a tip region, a distance between points where said upper half-frame is articulated to said pairs of first and second shoulders of said lower half-frame being approximately equal to half the length of the blade.

* * * * *